US006855371B2

(12) United States Patent
Gier et al.

(10) Patent No.: US 6,855,371 B2
(45) Date of Patent: Feb. 15, 2005

(54) METHOD FOR PRODUCING A MICROSTRUCTURED SURFACE RELIEF BY EMBOSSING THIXOTROPIC LAYERS

(75) Inventors: Andreas Gier, Melle (DE); Nora Kunze, Saarbruecken-Burbach (DE); Martin Mennig, Quierschied (DE); Peter W. Oliveira, Saarbruecken (DE); Stefan Sepeur, Wadgassen (DE); Bruno Schaefer, Losheim (DE); Helmut Schmidt, Saarbruecken-Guedingen (DE)

(73) Assignee: Institut fuer Neue Materialien gemeinnuetzige GmbH, Saarbruecken (DE)

( * ) Notice: Subject to any disclaimer, the term of this patent is extended or adjusted under 35 U.S.C. 154(b) by 170 days.

(21) Appl. No.: 10/169,971

(22) PCT Filed: Jan. 12, 2001

(86) PCT No.: PCT/EP01/00333

§ 371 (c)(1),
(2), (4) Date: Jul. 10, 2002

(87) PCT Pub. No.: WO01/51220

PCT Pub. Date: Jul. 19, 2001

(65) Prior Publication Data

US 2004/0026832 A1 Feb. 12, 2004

(Under 37 CFR 1.47)

(30) Foreign Application Priority Data

Jan. 13, 2000 (DE) ..... 100 01 135

(51) Int. Cl.[7] ..... B05D 3/12
(52) U.S. Cl. ..... 427/277; 427/271; 427/359
(58) Field of Search ..... 427/226, 356, 427/359, 369, 387, 162, 163.1, 271, 277, 278; 264/293

(56) References Cited

U.S. PATENT DOCUMENTS

| | | | | |
|---|---|---|---|---|
| 5,593,781 A | | 1/1997 | Nass et al. | |
| 5,644,014 A | | 7/1997 | Schmidt et al. | |
| 5,650,215 A | * | 7/1997 | Maruzek et al. | 428/156 |
| 5,716,679 A | * | 2/1998 | Krug et al. | 427/515 |
| 5,766,680 A | * | 6/1998 | Schmidt et al. | 427/226 |
| 6,236,493 B1 | | 5/2001 | Schmidt et al. | |
| 6,291,070 B1 | | 9/2001 | Arpac et al. | |
| 6,649,266 B1 | | 11/2003 | Gross et al. | |

FOREIGN PATENT DOCUMENTS

| | | |
|---|---|---|
| DE | 4118184 | 12/1992 |
| DE | 4212633 | 10/1993 |
| DE | 4417405 | 11/1995 |
| DE | 19613645 | 10/1997 |
| DE | 19746885 | 6/1999 |
| WO | WO 92/21729 | 12/1992 |
| WO | WO 93/06508 | 4/1993 |
| WO | WO 93/21127 | 10/1993 |
| WO | WO 95/31413 | 11/1995 |
| WO | WO 98/51747 | 11/1998 |
| WO | WO 00/62942 | 10/2000 |

OTHER PUBLICATIONS

A. Gombert et al., Thin Solid Films, 351(1,2), 1999, pp. 73–78.

* cited by examiner

*Primary Examiner*—Fred J. Parker
(74) *Attorney, Agent, or Firm*—Greenblum & Bernstein, P.L.C.

(57) ABSTRACT

A method is described for producing a microstructured surface relief by applying to a substrate a coating composition which is thixotropic or which acquires thixotropic properties by pretreatment on the substrate, embossing the surface relief into the applied thixotropic coating composition with an embossing device, and curing the coating composition following removal of the embossing device. The substrates obtainable by this method, provided with a microstructured surface relief, are particularly suitable for optical, electronic, micromechanical and/or dirt repellency applications.

38 Claims, 2 Drawing Sheets

METHOD FOR PRODUCING A MICROSTRUCTURED SURFACE RELIEF BY EMBOSSING THIXOTROPIC LAYERS

CROSS-REFERENCE TO RELATED APPLICATIONS

The present application is a U.S. National Stage of International Application No. PCT/EP01/00333, filed Jan. 12, 2001, which claims priority under 35 U.S.C. § 119 of German Patent Application No. 100 01 135.7, filed Jan. 13, 2000.

BACKGROUND OF THE INVENTION

1. Field of the Invention

The present invention relates to a method of producing microstructured surface reliefs, in which the surface relief is embossed with an embossing device into a thixotropic coating composition applied to a substrate; to substrates provided with this microstructured surface relief; and to the use of these substrates.

2. Discussion of Background Information

Surface relief structures are used for various fields of application. At the forefront stand decorative applications, on metal, plastic, card or stone, for example. Additionally, applications for producing nonslip floor coverings, footwear soles, finished textiles, structured soundproofing panels or electrical cables are specified. Methods used to produce relief structures with dimensions in the mm range include not only screen printing but also printing with structured rollers or casting. Factors governed by the application technology dictate the use of thixotropic, pseudoplastic or high-viscosity coating materials, with thixotroping being effected using additives known from the prior art. Said additives may include fine-scale inorganic powders, such as $SiO_2$ or $CaCO_3$. Thixotropic coating systems and binder systems may also be used to produce stochastic surface relief structures by way of spraying methods, with the addition of relatively coarse particles which determine the structural geometry.

An important part is played by roller embossing methods. A distinction is made here between hot embossing, the embossing of thixotropic coating materials, and reactive embossing. In the case of hot embossing, the embossing roll is pressed into a thermoplastic substrate which has been heated to above the glass transition point. After the roll has been withdrawn the structure is fixed by rapid cooling. Using small-sized, rigid dies, this method is also being investigated analogously for producing very fine structures in the $\mu$m and 100 nm range for electronic applications. Disadvantages here are inaccuracies, caused by the high thermal expansion coefficients of the thermoplastic polymers used, and the high restoring forces due to very small radii of curvature, which lead to rounding off of edges even on rapid cooling. Further disadvantages are the long process times and also the fundamental unsuitability for what is known as stepping, in which large areas are structured by a sequence of embossing operations on adjacent unit areas using a small die which is offset in steps. In the embossing of thixotropic coating materials, the thixotropic rheology of the coating material means that the relief is substantially retained, at least for a certain time, within which fixing can take place by curing or drying. To date, however, this method has been used only for producing relatively coarse structures with dimensions in the mm range.

In the case of structures with dimensions in the $\mu$m to nm range for optical or microelectronic applications, the faithfulness of reproduction is subject to very high requirements. Optical and microelectronic $\mu$m or nm structures therefore require near-net shaping with defined sidewall steepness.

Besides hot embossing, only reactive embossing has been used for surface relief structures with dimensions in the $\mu$m to nm range. In reactive embossing, it is vital that the structured coating film beneath the planar die used is cured by thermal treatment or UV irradiation before the impressed die can be removed from the coating film. This is also the case when further compaction takes place by a further, downstream temperature treatment. A. Gombert et al., Thin Solid Films, 351 (1,2) 1999, 73–78, assume that, even in the case of transfer of reactive embossing to the roller technology, curing must take place under the embossing die. The assumption is made that this is necessary in order to prevent the surface forces of the uncured layer, which are particularly high at small radii of curvature, from leading to rounding of the microstructure and thus to a loss of reproduction faithfulness in any attempt at thixotropic embossing. From a technological standpoint, however, curing following removal of the roll would be of particular interest, since it would allow surface reliefs on large areas, e.g., as motheye antireflection structures for display applications, to be produced by the roller method in a shorter and more reliable process than with curing under the roll.

The object on which the invention is based is therefore to provide a method of producing microstructures with dimensions in the lower $\mu$m to nm range which on the one hand ensures the stringent reproduction faithfulness requirements required in this dimensional range and on the other hand allows shorter production times.

SUMMARY OF THE INVENTION

The object of the invention is surprisingly achieved by a method of producing a microstructured surface relief by applying to a substrate a coating composition which is thixotropic or which acquires thixotropic properties by pretreatment on the substrate, embossing the surface relief into the applied thixotropic coating composition with an embossing device, and curing the coating composition following removal of the embossing device.

The process of the invention enables faithful reproduction with very high accuracy and sidewall steepness even in the microstructure range, situated well beyond the prior art. Moreover, the production times can be shortened substantially, which is particularly important for the microstructuring of large areas.

The coating composition may be applied by any customary means. All common wet-chemical coating methods may be used in this context. Examples are spin coating, (electro-) dip coating, knife coating, spraying, squirting, casting, brushing, flow coating, film casting, blade casting, slot coating, meniscus coating, curtain coating, roller application or customary printing methods, such as screen printing or flexoprint. Preference is given to continuous coating methods such as flat spraying, flexoprint methods, roller application or wet-chemical film coating techniques. The amount of coating composition applied is chosen so as to give the desired layer thickness. Operation takes place, for example, so as to give layer thicknesses before embossing that are in the range from 0.5 to 50 $\mu$m, preferably from 0.8 to 10 $\mu$m, with particular preference from 1 to 5 $\mu$m.

The coating composition may be thixotropic even before application or is pretreated following application to the substrate in such a way that it acquires thixotropic properties. Preference is given to using a coating composition which becomes thixotropic only following application to the substrate, by appropriate pretreatment. Thixotropy is a property of certain viscous compositions whose viscosity decreases on exposure to mechanical forces (transverse strain, shearing stress, etc). In the context of the present specification, the expressions "thixotropy" and "thixotropic" are used in the sense that they include pseudoplastic systems. Thixotropic systems in the narrower sense differ from pseudoplastic systems in that their change in viscosity takes place with a certain time delay (hysteresis). For this reason, thixotropic systems are preferred in accordance with the invention, although pseudoplastic systems can also be used with good results and are therefore embraced by the terms "thixotropy" and "thixotropic" as used herein.

The skilled worker is familiar with thixotropic compositions. He or she is also aware of measures, such as adding thixotropic agents or viscosity regulators, which lead to thixotropic compositions.

Where the coating composition is not yet thixotropic prior to application, the applied coating composition is pretreated in order to establish the thixotropic properties. Of course, a coating composition which was thixotropic prior to application can also be pretreated after application in order, for example, to accentuate the thixotropic properties. Likewise, of course, a coating composition which is not thixotropic must be selected in such a way that it is able to acquire the thixotropic quality by means of a pretreatment.

By pretreatment here is meant in particular a thermal treatment or a radiation treatment of the applied coating composition, which may also be employed in combination. Where appropriate, however, simple evaporation of the solvent (venting) may be sufficient to obtain thixotropic properties. Venting may also precede one of the abovementioned pretreatments. Examples of forms of radiation which can be used include IR radiation, UV radiation, electron beams and/or laser beams. Preferably, the pretreatment comprises a thermal treatment. For this purpose the coated substrate is heated, in an oven for example, for a certain period of time.

The temperature ranges used or the intensity of the radiation and the pretreatment period of course depend on one another and in particular on the coating composition, for example, the nature of the coating composition, the additives used, and the nature and amount of the solvent used. As a result of the processes which take place during pretreatment, such as evaporation of the solvent or condensation processes, the applied coating compositions become thixotropic. It should be ensured here that curing of the coating composition does not yet take place. The corresponding parameters are known to the skilled worker or may readily be ascertained by said worker by means of routine tests.

The pretreatment parameters, such as the temperature, are preferably chosen such that the residues of solvent present in the layer are substantially expelled but such that the coating composition is not yet cured, by way of crosslinking reactions, for example. This is particularly important in the presence of thermal initiators. In the case of thermal treatment the coated substrate is heated, for example, at temperatures in the range from 60 to 180° C., preferably from 80 to 120° C., for a period of, for example, from 30 s to 10 min. With particular preference the pretreatment is conducted in such a way that for the applied coating composition a viscosity of from 30 Pa s to 30 000 Pa s, preferably from 30 Pa s to 1 000 Pa s, with particular preference 30 Pa s–100 Pa s, is obtained. These are preferred ranges for unpretreated coating compositions as well. In the case, for example, of the coating compositions set out below that are based on organically modified inorganic polycondensates or precursors thereof, the pretreated layer may also be a gel.

Embossing of the microstructured surface relief is accomplished by way of a conventional embossing device. This may be, for example, a die or a roll, the use of rolls being preferred. For specific cases, for example, rigid dies are also suitable. The roll may be, for example, a manual roll or a mechanical embossing roll. Located on the embossing device is the negative image (negative master) of the microstructure to be embossed, which is obtained by impression from a positive master. The structure of the master may be flexible or rigid.

Depending, for example, on the structural geometry and degree of crosslinking of the coating film, typical pressing pressures are situated within the range from 0.1 to 100 MPa. Typical roll speeds are situated within the range from 0.6 m/min to 60 m/min. This underlines the great advantage of the method of the invention as compared with the reactive embossing used in accordance with the prior art, where about 10 minutes are needed in order to produce a microstructured surface relief with an area of 1 $cm^2$ in discontinuous operation.

In contrast to reactive embossing, where curing takes place while the embossing device is located in the coating composition, curing in accordance with the invention takes place only when the embossing device has been removed from the coating composition. Of course, this does not mean that the embossing device, such as in the case of the roller method, for instance, cannot be used at another place for a further or continuous embossing operation. What is essential is that the section of the embossed surface relief which is being subjected to curing is no longer in contact with the embossing device.

By curing is meant the hardening methods which are customary in coating technology and at the end of which it is substantially no longer possible to (permanently) deform the cured layer. Depending on the nature of the coating composition, the process which takes place here is, for example, a crosslinking, densification or vitrification, condensation or else drying. The curing and/or fixing of the embossed surface relief should take place within 1 minute, better still within 30 s, and preferably within 3 s following demolding—that is, following removal of the embossing device. Where appropriate, the cured layer may also be vitrified by means of thermal aftertreatment, in which organic components are burnt out in order to leave behind a purely inorganic matrix.

Curing is conducted in particular in the form of a thermal cure, a radiation cure or a combination thereof. Preference is given to using known radiation curing methods. Examples of types of radiation which can be used have been listed above for the pretreatment. The radiation cure takes place preferably by means of UV radiation or electron beams. In any case, the fixing operation should lead to the maximum possible crosslinking, densification or condensation of the coating.

Independently of any chance surface roughness that may be present, the surface relief structure constitutes a defined pattern of elevations and depressions in the surface layer. The pattern formed may be stochastic or periodic, although it is also possible for it to represent a certain desired image pattern. A microstructured surface profile has dimensions in the $\mu$m and/or nm range, the term "dimensions" referring to the sizes of the depressions and/or elevations (amplitude height) or the distances (periods) between them. It is also possible, however, to integrate superstructures as well, which may, for example, store particular information. Examples of such superstructures are light-directing or holographic structures and optical data storage systems. The reliefs present are microstructured even if, for example, depressions in the μm and/or nm range are there while the distances between the depressions are not within this range, and vice versa. Of course, larger structures may also be present on the surface in addition to the structures in the μm and/or nm range. The microstructured surface reliefs generally comprise structures having dimensions less than 800 μm, preferably less than 500 μm, with particular preference less than 200 μm. Even with even smaller dimensions below 30 μm and even in the nanometer range below 1 μm and even below 100 nm, good results are achieved.

The coating composition employed in accordance with the invention may be applied to any desired substrate. Examples thereof are metal, glass, ceramic, paper, plastic, textiles or natural materials such as wood, for example. Examples of metal substrates include copper, aluminum, brass, iron, and zinc. Examples of plastics substrates are polycarbonate, polymethyl methacrylate, polyacrylates, and polyethylene terephthalate. The substrate may be present in any form, as a plate or film, for example. Of course, surface-treated substrates are also suitable for producing microstructured surfaces, e.g., coated or metallized surfaces.

The coating compositions may be chosen such that opaque or transparent, electrically conducting, photoconductive or insulating coatings are obtained. For optical applications in particular, transparent coatings are preferably produced. The coatings may also be colored. The coating compositions may be in the form, for example, of gels, sols, dispersions or solutions.

In one preferred embodiment, the applied coating composition prior to the embossing operation is a gel. Preferably, the coating composition is applied as a sol to the substrate and is converted into the gel by the pretreatment, giving the thixotropic properties. Gel formation comes about, for example, by removal of solvent and/or by condensation processes.

The coating compositions may comprise customary coating systems based on organic polymers or glass-forming or ceramic-forming compounds as binders or matrix-forming constituents, provided the coating compositions are thixotropic or are able to acquire thixotropic properties by means of a pretreatment. As binders it is possible to use the organic polymers that are known to the skilled worker. The organic polymers used preferably also contain functional groups by way of which crosslinking is possible. Additionally, the coating compositions with organic polymer binders preferably further comprise nanoscale inorganic particulate solids, so that coatings are formed which are composed of a polymer layer compounded with nanoparticles. Suitable polymers include any known plastics, e.g., polyacrylic acid, polymethacrylic acid, polyacrylates, polymethacrylates, polyolefins, polystyrene, polyamides, polyimides, polyvinyl compounds, such as polyvinyl chloride, polyvinyl alcohol, polyvinyl butyral, polyvinyl acetate, and corresponding copolymers, e.g., poly(ethylene-vinyl acetate), polyesters, e.g., polyethylene terephthalate or polydiallyl phthalate, polyacrylates, polycarbonates, polyethers, e.g., polyoxymethylene, polyethylene oxide or polyphenylene oxide, polyether ketones, polysulfones, polyepoxides, and fluoropolymers, e.g., polytetrafluoroethylene.

Coating compositions based on glass-forming or ceramic-forming compounds may be coating compositions based on inorganic particulate solids, preferably nanoscale inorganic particulate solids, or hydrolyzable starting compounds, especially metal alkoxides or alkoxysilanes. Examples of nanoscale inorganic particulate solids and of hydrolyzable starting compounds are given below.

Particularly good results are obtained with coating compositions based on organically modified inorganic polycondensates (ormocers, nanomers, etc), examples being polyorganosiloxanes, or their precursors. Accordingly, the use of such coating compositions is particularly preferred. A further improvement may be obtained if the organically modified inorganic polycondensates or precursors thereof include organic radicals containing functional groups by way of which crosslinking is possible, and/or if they are present in the form of what are known as organic-inorganic nanocomposite materials. Coating compositions based on organically modified inorganic polycondensates which are suitable for the present invention are described, for example, in DE 19613645, WO 92/21729, and WO 98/51747, hereby incorporated by reference. These constituents are elucidated individually below.

The organically modified inorganic polycondensates or precursors thereof are prepared in particular by hydrolysis and condensation of hydrolyzable starting compounds in accordance with the sol-gel method, which is known from the prior art. By precursors in this context are meant, in particular, prehydrolyzates and/or precondensates having a relatively low degree of condensation. The hydrolyzable starting compounds comprise element compounds containing hydrolyzable groups, with at least some of these compounds also comprising nonhydrolyzable groups, or oligomers thereof.

Preferably at least 50 mol %, with particular preference at least 80 mol %, and with very particular preference 100 mol % of the hydrolyzable starting compounds used contain at least one nonhydrolyzable group.

Furthermore, mixtures of organic monomers, oligomers and/or polymers of customary type with the organic polymers may also be used.

The hydrolyzable starting compounds that are used to prepare the organically modified inorganic polycondensates or precursors thereof are particularly compounds of at least one element M from main groups III to V and/or transition groups II to IV of the periodic table of the elements. They preferably comprise hydrolyzable compounds of Si, Al, B, Sn, Ti, Zr, V or Zn, especially those of Si, Al, Ti or Zr, or mixtures of two or more of these elements. On this point it is noted that it is of course possible to use other hydrolyzable compounds as well, especially those of elements from main groups I and II of the periodic table (e.g., Na, K, Ca and Mg) and from transition groups V to VIII of the periodic table (e.g., Mn, Cr, Fe, and Ni). Hydrolyzable compounds of the lanthanides may also be used. Preferably, however, the last-mentioned compounds account for not more than 40 mol % and in particular not more than 20 mol % of the total hydrolyzable monomeric compounds used. When highly reactive hydrolyzable compounds (e.g., aluminum compounds) are used, it is advisable to use complexing agents, which prevent spontaneous precipitation of the corresponding hydrolyzates following addition of water. WO 92/21729 specifies suitable complexing agents which may be used with reactive hydrolyzable compounds.

As a hydrolyzable starting compound which contains at least one nonhydrolyzable group, preference is given to using hydrolyzable organosilanes or oligomers thereof. Accordingly, organosilanes which can be used are elucidated in more detail below. Corresponding hydrolyzable starting compounds of other of the abovementioned elements are derived analogously from the hydrolyzable and nonhydrolyzable radicals listed below, taking into account where appropriate the differing valence of the elements. These compounds as well, besides the hydrolyzable groups, contain preferably only one nonhydrolyzable group.

One preferred coating composition, accordingly, preferably comprises a polycondensate, or precursors thereof, which is obtainable, for example, by the sol-gel method and is based on one or more silanes of the general formula $R_a—Si—X_{(4-a)}$ (I), in which the radicals R are identical or different and are nonhydrolyzable groups, the radicals X are identical or different and are hydrolyzable groups or hydroxyl groups, and a is 1, 2 or 3, or an oligomer derived therefrom. The index a is preferably 1.

In the general formula (I) the hydrolyzable groups X, which may be identical or different from one another, are, for example, hydrogen or halogen (F, Cl, Br or I), alkoxy (preferably $C_{1-6}$ alkoxy, such as methoxy, ethoxy, n-propoxy, isopropoxy and butoxy, for example), aryloxy (preferably $C_{6-10}$ aryloxy, such as phenoxy, for example), acyloxy (preferably $C_{1-6}$ acyloxy, such as acetoxy or propionyloxy, for example), alkylcarbonyl (preferably $C_{2-7}$ alkycarbonyl, such as acetyl, for example), amino, monoalkylamino or dialkylamino having preferably from 1 to 12, in particular from 1 to 6, carbon atoms. Preferred hydrolyzable radicals are halogen, alkoxy groups, and acyloxy groups. Particularly preferred hydrolyzable radicals are $C_{1-4}$ alkoxy groups, especially methoxy and ethoxy.

The nonhydrolyzable radicals R, which may be identical to or different from one another, may be nonhydrolyzable radicals R containing a functional group by way of which crosslinking is possible, or may be nonhydrolyzable radicals R without a functional group.

The nonhydrolyzable radical R without a functional group is, for example, alkyl (preferably $C_{1-6}$ alkyl, such as methyl, ethyl, n-propyl, isopropyl, n-butyl, s-butyl and t-butyl, pentyl, hexyl, octyl or cyclohexyl), aryl (preferably $C_{6-10}$ aryl, such as phenyl and naphthyl for example), and also corresponding alkylaryls and arylalkyls. The radicals R and X may where appropriate contain one or more customary substituents, such as halogen or alkoxy, for example.

Specific examples of functional groups by way of which crosslinking is possible are, for example, the epoxide, hydroxyl, ether, amino, monoalkylamino, dialkylamino, optionally substituted anilino, amide, carboxyl, vinyl, allyl, alkynyl, acryloyl, acryloyloxy, methacryloyl, methacryloyloxy, mercapto, cyano, alkoxy, isocyanato, aldehyde, alkylcarbonyl, acid anhydride and phosphoric acid groups. These functional groups are attached to the silicon atom by way of alkylene, alkenylene or arylene bridge groups, which may be interrupted by oxygen or —NH— groups. Examples of nonhydrolyzable radicals R containing vinyl or alkynyl groups are $C_{2-6}$ alkenyl, such as vinyl, 1-propenyl, 2-propenyl and butenyl and $C_{2-6}$ alkynyl, such as acetylenyl and propargyl, for example. Said bridge groups and any substituents present, as in the case of the alkylamino groups, are derived, for example, from the abovementioned alkyl, alkenyl or aryl radicals. Of course, the radical R may also contain more than one functional group.

Specific examples of nonhydrolyzable radicals R containing functional groups by way of which crosslinking is possible are a glycidyl- or a glycidyloxy-($C_{1-20}$)-alkylene radical, such as β-glycidyloxyethyl, γ-glycidyloxypropyl, δ-glycidyloxybutyl, ε-glycidyloxypentyl, ω-glycidyloxyhexyl, and 2-(3,4-epoxycyclohexyl)ethyl, a (meth) acryloyloxy-($C_{1-6}$)-alkylene radical, where ($C_{1-6}$)-alkylene stands, for example, for methylene, ethylene, propylene or butylene, and a 3-isocyanatopropyl radical.

Specific examples of corresponding silanes are γ-glycidyloxypropyltrimethoxysilane (GPTS), γ-glycidyloxypropyltriethoxysilane (GPTES), 3-isocyanatopropyltriethoxysilane, 3-isocyanatopropyldimethylchlorosilane, 3-aminopropyltrimethoxysilane (APTS), 3-aminopropyltriethoxysilane, N-(2-aminoethyl)-3-aminopropyltrimethoxysilane, N-[N'-(2'-aminoethyl)-2-aminoethyl]-3-aminopropyltrimethoxysilane, hydroxymethyltriethoxysilane, bis(hydroxyethyl)-3-aminopropyltriethoxysilane, N-hydroxy-ethyl-N-methylaminopropyltriethoxysilane, 3-(meth) acryloyloxypropyltriethoxysilane and 3-(meth) acryloyloxypropyltrimethoxysilane. Further examples of hydrolyzable silanes which can be used in accordance with the invention can be found, for example, in EP-A-195493, inter alia.

The abovementioned functional groups by way of which crosslinking is possible are, in particular, addition-polymerizable and/or polycondensable groups, the term "polycondensation reactions" embracing polyaddition reactions as well. Where used, the functional groups are preferably selected such that crosslinking may be performed by way of catalyzed or uncatalyzed addition-polymerization, polyaddition or polycondensation reactions.

It is possible to use functional groups which are able to enter into the abovementioned reactions with themselves. Examples of such functional groups are epoxy-containing groups and reactive carbon-carbon multiple bonds (especially double bonds). Specific and preferred examples of such functional groups are above-recited glycidyloxy and (meth)acryloyloxy radicals. Additionally, the functional groups in question may comprise groups which are able to enter into appropriate reactions with other functional groups (referred to as corresponding functional groups). In that case hydrolyzable starting compounds are used which contain both functional groups, or mixtures which contain the respective corresponding functional groups. If only one functional group is present in the polycondensate or in the precursor therefor, the appropriate corresponding functional group may be present in the crosslinking agent that may then be used. Examples of corresponding functional group pairings are vinyl/SH, epoxy/amine, epoxy/alcohol, epoxy/carboxylic acid derivatives, methacryloyloxy/amine, allyl/amine, amine/carboxylic acid, amine/isocyanate, isocyanate/alcohol or isocyanate/phenol. Where isocyanates are used, they are preferably employed in the form of blocked isocyanates.

In one preferred embodiment, use is made of organically modified inorganic polycondensates or precursors thereof based on hydrolyzable starting compounds, with at least some of the hydrolyzable compounds used being the hydrolyzable compounds elucidated above and having at least one nonhydrolyzable radical containing a functional group by way of which crosslinking is possible. With preference at least 50 mol %, with particular preference at least 80 mol %, and with very particular preference 100 mol % of the hydrolyzable starting compounds used contain at least one nonhydrolyzable radical containing a functional group by way of which crosslinking is possible.

Particular preference is given to using for this purpose γ-glycidyloxypropyltrimethoxysilane (GPTS), γ-glycidyloxypropyltriethoxysilane (GPTES), 3-(meth) acryloyloxypropyltrimethoxysilane and 3-(meth) acryloyloxypropyltrimethoxysilane.

It is also possible to use organically modified inorganic polycondensates or precursors thereof which contain, at least in part, organic radicals substituted by fluorine. For this purpose it is possible, in addition or alone, to make use, for example, of hydrolyzable silicon compounds having at least one nonhydrolyzable radical having from 2 to 30 fluorine atoms attached to carbon atoms which are preferably separated from Si by at least two atoms. Hydrolyzable groups which can be used in this case include, for example, those specified for X in formula (I). Specific examples of fluorosilanes are $C_2F_5$—$CH_2CH_2$—$SiZ_3$, n-$C_6F_{13}$—$CH_2CH_2$—$SiZ_3$, n-$C_8F_{17}$—$CH_2CH_2$—$SiZ_3$, n-$C_{10}F_{21}$—$CH_2CH_2$—$SiZ_3$, where (Z=$OCH_3$, $OC_2H_5$ or Cl); iso-$C_3F_7O$—$CH_2CH_2CH_2$—$SiCl_2(CH_3)$, n-$C_6F_{13}$—$CH_2CH_2$—$SiCl_2(CH_3)$ and n-$C_6F_{13}$—$CH_2CH_2$—$SiCl(CH_3)_2$. The result of using a fluorinated silane of this kind is that the corresponding coating is additionally given hydrophobic and oleophobic properties. Silanes of this kind are described in detail in DE 4118184. These fluorinated silanes are preferably used when rigid dies are employed. The fraction of fluorinated silanes is preferably from 0.5 to 2% by weight, based on the total organically modified inorganic polycondensate used.

As already set out above, the organically modified inorganic condensates may also be prepared using in part hydrolyzable starting compounds containing no nonhydrolyzable groups. For the hydrolyzable groups which can be used and the elements M which can be used, refer to the above remarks. Particular preference is given for this purpose to using alkoxides of Si, Zr and Ti. Coating compositions of this kind based on hydrolyzable compounds containing nonhydrolyzable groups and hydrolyzable compounds without nonhydrolyzable groups are described, for example, in WO 95/31413 (DE 4417405), hereby incorporated by reference. In these coating compositions the surface relief may be identified by thermal aftertreatment to give a glasslike or ceramic microstructure.

Specific examples are set out below.

$Si(OCH_3)_4$, $Si(OC_2H_5)_4$, Si(O-n- or iso-$C_3H_7)_4$, $Si(OC_4H_9)_4$, $SiCl_4$, $HSiCl_3$, $Si(OOCC_3H)_4$, $Al(OCH_3)_3$, $Al(OC_2H_5)_3$, Al(O-n-$C_3H_7)_3$, Al(O-iso-$C_3H_7)_3$, $Al(OC_4H_9)_3$, Al(O-iso-$C_4H_9)_3$, Al(O-sec-$C_4H_9)_3$, $AlCl_3$, $AlCl(OH)_2$, $Al(OC_2H_4OC_4H_9)_3$, $TiCl_4$, $Ti(OC_3H_5)_4$, $Ti(OC_3H_7)_4$, Ti(O-iso-$C_3H_7)_4$, $Ti(OC_4H_9)_4$, Ti(2-ethylhexoxy)$_4$; $ZrCl_4$, $Zr(OC_2H_5)_4$, $Zr(OC_3H_7)_4$, Zr(O-iso-$C_3H_7)_4$, $Zr(OC_4H_9)_4$, $ZrOCl_2$, Zr(2-ethylhexoxy)$_4$, and also Zr compounds containing complexing radicals, such as, for example, β-diketone and methacryloyl radicals, $BCl_3$, $B(OCH_3)_3$, $B(OC_2H_5)_3$, $SnCl_4$, $Sn(OCH_3)_4$, $Sn(OC_2H_5)_4$, $VOCl_3$ and $VO(OCH_3)_3$.

A further improvement in results is obtained if coating compositions based on organic-inorganic nanocomposites are used. These are, in particular, composites based on the hydrolyzable starting compounds set out above, where at least one portion contains nonhydrolyzable groups, and nanoscale inorganic particulate solids, or are composites based on nanoscale inorganic particulate solids modified with organic surface groups. These organic-inorganic nanocomposites of the first case may be obtained by simple mixing of the organically modified inorganic polycondensates or precursors thereof which are obtained from the hydrolyzable starting compounds with the nanoscale inorganic particulate solids. However, it is also possible for the hydrolysis and condensation of the hydrolyzable starting compounds to take place preferably in the presence of the particulate solids. In another embodiment, nanocomposites are prepared by compounding soluble organic polymers with the nanoscale particles.

The nanoscale inorganic particulate solids may be composed of any desired inorganic materials but are preferably composed of metals or metal compounds such as, for example, (possibly hydrated) oxides such as ZnO, CdO, $SiO_2$, $TiO_2$, $ZrO_2$, $CeO_2$, $SnO_2$, $Al_2O_3$, $In_2O_3$, $La_2O_3$, $Fe_2O_3$, $Cu_2O$, $Ta_2O_5$, $Nb_2O_5$, $V_2O_5$, $MoO_3$ or $WO_3$; chalcogenides such as, for example, sulfides (e.g., CdS, ZnS, PbS, and $Ag_2S$), selenides (e.g., GaSe, CdSe and ZnSe) and tellurides (e.g., ZnTe or CdTe), halides such as AgCl, AgBr, AgI, CuCl, CuBr, $CdI_2$ and $PbI_2$; carbides such as $CdC_2$ or SiC; arsenides such as AlAs, GaAs, and GeAs; antimonides such as InSb; nitrides such as BN, AlN, $Si_3N_4$, and $Ti_3N_4$; phosphides such as GaP, InP, $Zn_3P_2$, and $Cd_3P_2$; phosphates, silicates, zirconates, aluminates, stannates, and the corresponding mixed oxides (e.g. metal-tin oxides, such as indium-tin oxide (I TO), antimony-tin oxide (ATO), fluorine-doped tin oxide (FTO), Zn-doped $Al_2O_3$, fluorescent pigments with Y or Eu compounds, or mixed oxides with perovskite structure such as $BaTiO_3$ and $PbTiO_3$). It is possible to use one kind of nanoscale inorganic particulate solids or a mixture of different nanoscale inorganic particulate solids.

The nanoscale inorganic particulate solids preferably comprise an oxide, oxide hydrate, nitride or carbide of Si, Al, B, Zn, Cd, Ti, Zr, Ce, Sn, In, La, Fe, Cu, Ta, Nb, V, Mo or W, with particular preference of Si, Al, B, Ti, and Zr. Particular preference is given to using oxides and oxide hydrates. Preferred nanoscale inorganic particulate solids are $SiO_2$, $Al_2O_3$, ITO, ATO, AlOOH, $ZrO_2$ and $TiO_2$, such as boehmite and colloidal $SiO_2$. Particularly preferred nanoscale $SiO_2$ particles are commercial silica products, e.g., silica sols, such as the Levasils®, silica sols from Bayer AG, or pyrogenic silicas, examples being the Aerosil products from Degussa.

The nanoscale inorganic particulate solids generally possess a particle size in the range from 1 to 300 nm or from 1 to 100 nm, preferably from 2 to 50 nm, and with particular preference from 5 to 20 nm. This material may be used in the form of a powder but is preferably used in the form of a stabilized sol, in particular an acidically or alkalinically stabilized sol.

The nanoscale inorganic particulate solids may be used in an amount of up to 50% by weight, based on the solids components of the coating composition. In general the amount of nanoscale inorganic particulate solids is in the range from 1 to 40% by weight, preferably from 1 to 30% by weight, with particular preference from 1 to 15% by weight.

The organic-inorganic nanocomposites may comprise composites based on nanoscale inorganic particulate solids modified with organic surface groups. The surface modification of nanoscale particulate solids is a method which is known in the prior art, as described, for example, in WO 93/21127 (DE 4212633). Preference is given in this case to using nanoscale inorganic particulate solids which are provided with addition-polymerizable and/or polycondensable organic surface groups or with surface groups which possess a polarity or chemical structure which is similar to that of the matrix. Addition-polymerizable and/or polycondensable nanoparticles of this kind, and their preparation, are described, for example, in WO 98/51747 (DE 19746885).

The preparation of the nanoscale inorganic particulate solids provided with addition-polymerizable and/or polycondensable organic surface groups may in principle be carried out in two different ways, namely first by surface modification of pre-prepared nanoscale inorganic particulate solids and secondly by preparation of these inorganic nanoscale particulate solids using one or more compounds which possess addition-polymerizable and/or polycondensable groups of this kind. These two ways are elucidated further in the abovementioned patent application.

The organic addition-polymerizable and/or polycondensable surface groups may comprise any groups known to the skilled worker that are amenable to addition polymerization or polycondensation. Attention is drawn here in particular to the functional groups, already mentioned above, by way of which crosslinking is possible. Preference is given in accordance with the invention to surface groups which possess a (meth)acryloyl, allyl, vinyl or epoxy group, with (meth) acryloyl and epoxy groups being particularly preferred. The polycondensable groups include, for example, isocyanate, alkoxy, hydroxyl, carboxyl, and amino groups, by means of which urethane, ether, ester, and amide linkages can be obtained between the nanoscale particles.

Also preferred in accordance with the invention is for the organic groups present on the surfaces of the nanoscale particles, and containing the addition-polymerizable and/or polycondensable groups, to have a relatively low molecular weight. In particular, the molecular weight of the (purely organic) groups ought not to exceed 500 and preferably 300, with particular preference 200. Of course, this does not exclude a significantly higher molecular weight of the compounds (molecules) containing these groups (e.g., 1000 or more).

As already mentioned above, the addition-polymerizable/polycondensable surface groups may in principle be provided in two ways. Where surface modification of pre-prepared nanoscale particles is carried out, compounds suitable for this purpose are all those (preferably of low molecular weight) which on the one hand possess one or more groups which are able to react or at least interact with (functional) groups that are present on the surface of the nanoscale particulate solids (such as OH groups, for example, in the case of oxides) and on the other hand contain at least one addition-polymerizable/polycondensable group. Accordingly, the corresponding compounds may, for example, form not only covalent but also ionic (saltlike) or coordinative (complex or chelate) bonds to the surface of the nanoscale particulate solids, whereas the simple interactions would include, for example, dipole-dipole interactions, hydrogen bonding, and van der Waals interactions. Preference is given to the formation of covalent and/or coordinative bonds. Specific examples of organic compounds which can be used for surface modification of the nanoscale inorganic particulate solids include unsaturated carboxylic acids such as acrylic acid and methacrylic acid, β-dicarbonyl compounds (e.g., β-diketones or β-carbonyl carboxylic acids) with polymerizable double bonds, ethylenically unsaturated alcohols and amines, epoxides, and the like. Such compounds used for particular preference in accordance with the invention are—especially in the case of oxide-type particles—hydrolytically condensable silanes containing at least (and preferably) one nonhydrolyzable radical by way of which crosslinking is possible.

For examples of these hydrolyzable silanes containing functional groups by way of which crosslinking is possible, refer to the above remarks relating to formula (I) in respect of the hydrolyzable starting compounds. Preferred examples are silanes of the general formula (II):

$$Y—R^1—SiR^2_3 \quad (I)$$

in which Y stands for $CH_2=CR^3—COO$, $CH_2=CH$, glycidyloxy, an amine or acid anhydride group, $R^3$ represents hydrogen or methyl, $R^1$ is a divalent hydrocarbon radical having from 1 to 10, preferably 1 to 6, carbon atoms, containing if desired one or more heteroatom groups (e.g., O, S, NH) which separate adjacent carbon atoms from one another, and the radicals $R^2$, identical to or different from one another, are selected from alkoxy, aryloxy, acyloxy, and alkylcarbonyl groups and also halogen atoms (especially F, Cl and/or Br).

The groups $R^2$ are preferably identical and selected from halogen atoms, $C_{1-4}$ alkoxy groups (e.g., methoxy, ethoxy, n-propoxy, isopropoxy, and butoxy), $C_{6-10}$ aryloxy groups (e.g., phenoxy), $C_{1-4}$ acyloxy groups (e.g., acetoxy and propionyloxy), and $C_{2-10}$ alkylcarbonyl groups (e.g., acetyl). Particularly preferred radicals $R^2$ are $C_{1-4}$ alkoxy groups and especially methoxy and ethoxy. The radical $R^1$ is preferably an alkylene group, particularly one having from 1 to 6 carbon atoms, such as ethylene, propylene, butylene, and hexylene, for example. If X stands for $CH_2=CH$, $R^1$ preferably denotes methylene and in that case may also denote a simple bond.

Preferably, Y represents $CH_2=CR^3—COO$ (in which $R^3$ is preferably $CH_3$) or glycidyloxy. Accordingly, particularly preferred silanes of the general formula (II) are (meth) acyloyloxyalkyltrialkoxysilanes such as 3-methacryloyloxypropyltri(m)ethoxysilane, for example, and glycidyloxyalkyltrialkoxysilanes such as 3-glycidyloxypropyltri(m)ethoxysilane, for example.

Regarding the in situ preparation of nanoscale inorganic particulate solids containing addition-polymerizable/polycondensable surface groups, refer to WO 98/51747 (DE 19746885).

Surprisingly, the organically modified inorganic polycondensates or their precursors, and especially the organic-inorganic nanocomposites, present prior to the embossing operation in the form of gel layers, which come about primarily by condensation of the participant silanol groups and removal of solvent, possess such a strongly pronounced thixotropic character that dimensionally faithful impression with very small structural dimensions, even in the microstructure range, leads to very high accuracy and sidewall steepness, which lies well beyond the prior art. As a result of the organic-inorganic hybrid character, the gels are substantially more flexible than purely inorganic gels produced from metal alkoxides, and yet more stable than solvent-free organic monomer/oligomer layers. The same applies to organic-inorganic composites without nanoparticles; however, the thixotropic character is promoted by compositing with inorganic nanoparticles.

In one particularly preferred embodiment, the coating composition prior to the embossing operation is present in the form of a thixotropic gel obtained by solvent removal and substantially complete condensation of the inorganically condensable groups present, so that the degree of condensation of the inorganic matrix is very high or substantially complete. Subsequent curing then brings about organic crosslinking of the organic radicals present in the gel that contain functional groups by way of which crosslinking is possible (addition polymerization and/or polycondensation).

The coating composition may if desired comprise spacers. By spacers are meant organic compounds which preferably contain at least two functional groups which are able to enter into interaction with the components of the coating composition, especially with the functional groups of the polycondensates by way of which crosslinking is possible, or with the addition-polymerizable and/or polycondensable groups of the nanoscale inorganic particulate solids, and thereby bring about, for example, a flexibilization of the layer. Counting from the group which attaches to the surface, the spacers preferably have at least 4 $CH_2$ groups before the organic functional group; it is also possible for a $CH_2$ group to have been replaced by an —O—, —NH— or —CONH— group.

Organic compounds, such as phenols for example, may be introduced into the coating composition as spacers or else as connecting bridges. The compounds used most frequently for this purpose are bisphenol A, (4-hydroxyphenyl) adamantane, hexafluorobisphenol A, 2,2-bis(4-hydroxyphenyl)-perfluoropropane, 9,9-bis (4-hydroxyphenyl)fluorenone, 1,2-bis-3-(hydroxyphenoxy)ethane, 4,4'-hydroxyoctafluorobiphenyl, and tetraphenolethane.

Examples of components which can be used as spacers in the case of coating compositions based on (meth)acrylate are bisphenol A bisacrylate, bisphenol A bismethacrylate, trimethylolpropane triacrylate, trimethylolpropane trimethacrylate, neopentyl glycol dimethacrylate, neopentyl glycol diacrylate, diethylene glycol diacrylate, diethylene glycol dimethacrylate, triethylene glycol diacrylate, diethylene glycol dimethacrylate, tetraethylene glycol diacrylate, tetraethylene glycol dimethacrylate, polyethylene glycol diacrylate, polyethylene glycol dimethacrylate, 2,2,3,3-tetrafluoro-1,4-butandediol diacrylate and dimethacrylate, 1,1,5,5-tetrahydroperfluoropentyl 1,5-diacrylate and 1,5-dimethacrylate, hexafluorobisphenol A diacrylate and dimethacrylate, octafluorohexane-1,6-diol diacrylate and dimethacrylate, 1,3-bis(3-methacryloyloxypropyl)tetrakis (trimethylsiloxy)disiloxane, 1,3-bis(3-acryloyloxypropyl)-tetrakis(trimethylsiloxy)disiloxane, 1,3-bis(3-methacryloyloxypropyl)tetramethyldisiloxane, and 1,3-bis (3-acryloyloxypropyl)tetramethyldisiloxane.

It is also possible to use polar spacers, by which are meant organic compounds containing at least two functional groups (epoxy, (meth)acryloyl, mercapto, vinyl, etc) at the ends of the molecule, which owing to the incorporation of aromatic or heteroaromatic groups (such as phenyl, benzyl, etc.) and heteroatoms (such as O, S, N, etc.) possess polar properties and are able to enter into interaction with the components of the coating composition.

Examples of the abovementioned polar spacers are:

a) Epoxy-based:

Poly(phenyl glycidyl ether)-co-formaldehyde, bis (3,4-epoxycyclohexylmethyl) adipate, 3-[bis (2,3-epoxypropoxymethyl)methoxy]-1,2-propanediol, 4,4-methylenebis(N,N-diglycidylaniline), bisphenol A diglycidyl ether, N,N-bis(2,3-epoxypropyl)-4-(2,3-epoxypropoxy)aniline, 3,4-epoxycyclohexylmethyl 3,4-epoxycyclohexanecarboxylate, glycerol propoxylate triglycidyl ether, diglycidyl hexahydrophthalate, tris(2,3-epoxypropyl) isocyanurate, poly(propylene glycol) bis(2,3-epoxypropyl ether), 4,4'-bis(2,3-epoxypropoxy)biphenyl.

b) Methacrylic- and Acrylic-based:

Bisphenol A dimethacrylate, tetraethylene glycol dimethacrylate, 1,3-diisopropenylbenzene, divinylbenzene, diallyl phthalate, triallyl 1,3,5-benzenetricarboxylate, 4,4'-isopropylidenediphenol dimethacrylate, 2,4,6-triallyloxy-1,3,5-triazine, 1,3-diallylurea, N,N'-methylenebisacrylamide, N,N'-ethylenebisacrylanude, N,N'-(1,2-dihydroxyethylene) bisacrylamide, (+)-N,N'-diallyltartardiamide, methacrylic anhydride, tetraethylene glycol diacrylate, pentaerythritol triacrylate, diethyl diallylmalonate, ethylene diacrylate, tripropylene glycol diacrylate, ethylene glycol dimethacrylate, triethylene glycol dimethacrylate, 1,4-butanediol dimethacrylate, 1,6-hexanediol diacrylate, 2-ethyl-2-(hydroxymethyl)-1,3-propanediol trimethacrylate, allyl methacrylate, diallyl carbonate, diallyl succinate, diallyl pyrocarbonate.

The organic-inorganic nanocomposites may where appropriate further comprise organic polymers which may possess functional groups for the purpose of crosslinking. For examples, refer to the examples set out above of the coating composition based on organic polymers.

In the coating composition there may be further additives present which in the art are normally added in accordance with the purpose and desired properties. Specific examples are thixotropic agents, crosslinking agents, solvents, e.g., high-boiling solvents, organic and inorganic color pigments, including those in the nanoscale region, metal colloids, e.g., as carriers of optical functions, dyes, UV absorbers, lubricants, leveling agents, wetting agents, adhesion promoters, and initiators.

The initiator may serve for thermally or photochemically induced crosslinking. By way of example, it may be a thermally activatable free-radical initiator, such as a peroxide or an azo compound, for example, which initiates the thermal polymerization of, say, methacryloyloxy groups only at elevated temperature. Another possibility is for the organic crosslinking to take place by way of actinic radiation, e.g., UV light or laser light or electron beams. The crosslinking of double bonds, for example, takes place generally under UV irradiation.

Suitable initiators include all common initiator/initiating systems that are known to the skilled worker, including free-radical photoinitiators, free-radical thermal initiators, cationic photoinitiators, cationic thermal initiators, and any desired combinations thereof.

Specific examples of free-radical photoinitiators which can be used include Irgacure® 184 (1-hydroxycyclohexyl phenyl ketone), Irgacure® 500 (1-hydroxycyclohexyl phenyl ketone, benzophenone), and other photoinitiators of the Irgacure® type, available from Ciba-Geigy; Darocur® 1173, 1116, 1398, 1174 and 1020 (available from Merck); benzophenone, 2-chlorothioxanthone, 2-methylthioxanthone, 2-isopropylthioxanthone, benzoin, 4,4'-dimethoxybenzoin, benzoin ethyl ether, benzoin isopropyl ether, benzil dimethyl ketal, 1,1,1-tri-chloroacetophenone, diethoxyacetophenone, and dibenzosuberone.

Examples of free-radical thermal initiators include organic peroxides in the form of diacyl peroxides, peroxydicarbonates, alkyl peresters, alkyl peroxides, perketals, ketone peroxides, and alkyl hydroperoxides, and also azo compounds. Specific examples that might be mentioned here include, in particular, dibenzoyl peroxide, tert-butyl perbenzoate, and azobisisobutyronitrile.

One example of a cationic photoinitiator is Cyracure® UVI-6974, while a preferred cationic thermal initiator is 1-methylimidazole.

These initiators are used in the customary amounts known to the skilled worker, preferably from 0.01–5% by weight, especially 0.1–2% by weight, based on the total solids content of the coating composition. Under certain circumstances it is of course possible to do without the initiator entirely, such as in the case of electron beam curing or laser curing, for example.

As crosslinking agent it is possible to use the organic compounds containing at least two functional groups that are customary in the prior art. The functional groups are to be chosen such that crosslinking of the coating composition can take place by way of them, of course.

The substrates with a microstructure to the surface relief that are obtainable by the method of the invention can be used with advantage for producing optical or electronic microstructures. Examples of fields of application are in optical components, such as microlenses and microlens arrays, fresnel lenses, microfresnel lenses and arrays, light guide systems, optical waveguides and waveguide components, optical gratings, diffraction gratings, holograms, data storage media, digital, optically readable memories, antireflective (motheye) structures, light traps for photovoltaic applications, labeling, embossed antiglare coatings, microreactors, microtiter plates, relief structures on aerodynamic and hydrodynamic surfaces, and surfaces with special tactility, transparent, electrically conductive relief structures, optical reliefs on PC or PMMA sheets, security marks, reflective coats for road signs, stochastic microstructures with fractal substructures (lotus leaf structures), and embossed resist structures for the patterning of semiconductor materials.

BRIEF DESCRIPTION OF THE DRAWINGS

The invention is described in detail below with reference to the appended drawings, wherein.

DETAILED DESCRIPTION OF THE INVENTION

Figure 1:
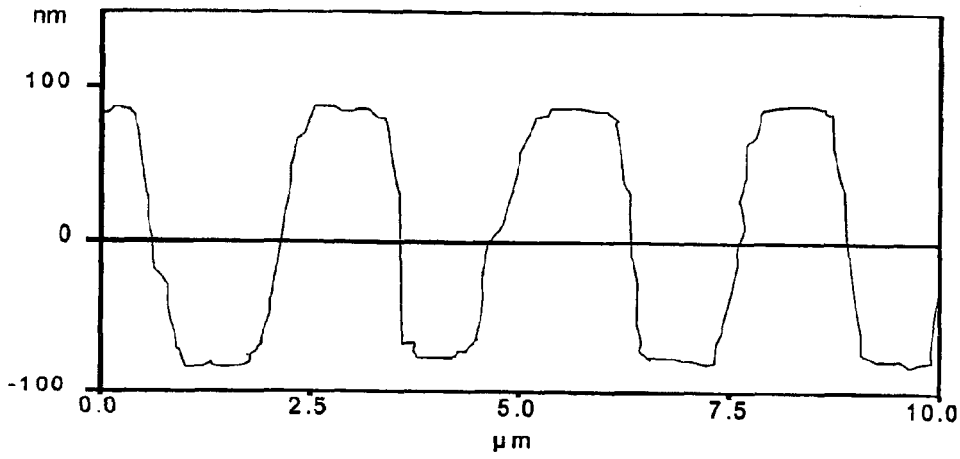
FIG. 1 shows the structure of a positive master for impressing a structure in the rim range used in one embodiment of the method of the present invention.

The examples which follow illustrate the invention without restricting it.

EXAMPLE 1

Preparation of a Coating Composition a) Preparation of the Hydrolyzate 131.1 g of boehmite (Disperal Sol P3) were charged to a 1 l three-necked flask with intensive reflux condenser and 327.8 g of 3-methacryloyloxypropyltrimethoxysilane (MPTS) were added. The mixture was heated to 80° C. with stirring and was boiled under reflux for 10 minutes. Then 47.5 g of water (double-distilled) were added with stirring and the mixture was heated further to 100° C. After about 10 minutes, severe foaming of the reaction mixture was noted. The mixture was then boiled under reflux for a further 2.5 hours. Finally, the hydrolyzate was cooled to room temperature and filtered (pressure filtration: 1. glass fiber prefilter; 2. fine filter 1 μm).

b) Preparation of the End Formulation 60 g of hydrolyzate were mixed with 9 g of amine-modified epoxy acrylate (UCB Chemical) as spacer, 0.6 g of leveling agent Byk® 306, 48 g of 1-butanol and 0.62 g (3 mol % in respect of the amount of double bonds) of benzophenone as photoinitiator.

Production of Microstructured Surface Reliefs

The above coating composition was applied to PC and PMMA sheets by flow coating and to PET film by knife coating (wet film thickness 25–50 μm). The coating was then predried in a drying cabinet at 90° C. for 4 minutes. Structuring was carried out using the following rolls:

a) Digital Structure

Production of the roll: a negative Ni master structure (120–160 nm amplitude height) was adhesively bonded to an iron cylinder (diameter 400 mm, length 400 mm).

The structure of the positive master used for impressing a digital structure in the nm range (AFM depth profile) is shown in FIG. 1. Deep-lying structures can be seen with high sidewall steepness and with an amplitude of about 160 nm and a period of 2.5 μm.

Figure 2:
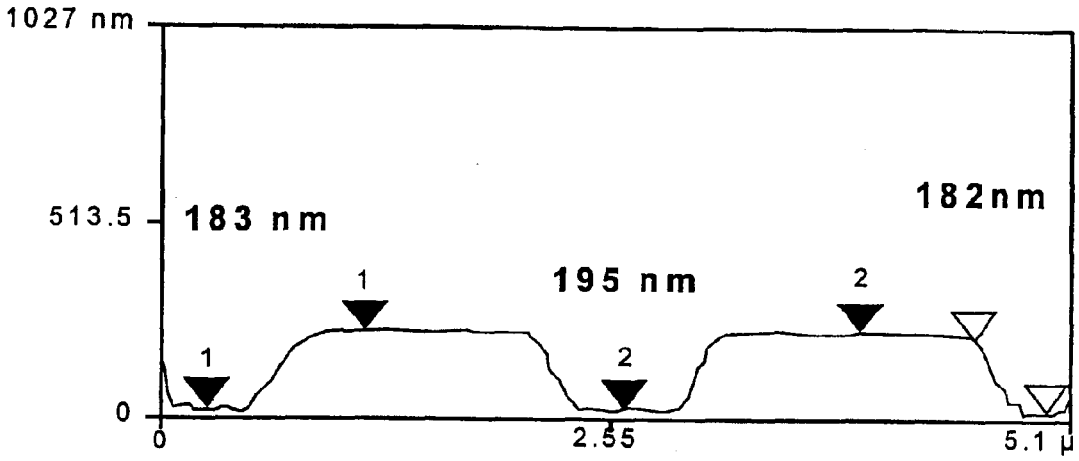
FIG. 2 shows the structure impressed with the master of FIG. 1.

FIG. 2 shows the structure of the digital structure impressed with the negative master (master from FIG. 1) (AFM depth profile). Here again, deep-lying troughs (depth about 180 nm) can be seen with high sidewall steepness, underlining the high reproduction accuracy of the method of the invention with the nanocomposite gel used.

b) μm Relief Structure

Figure 3:
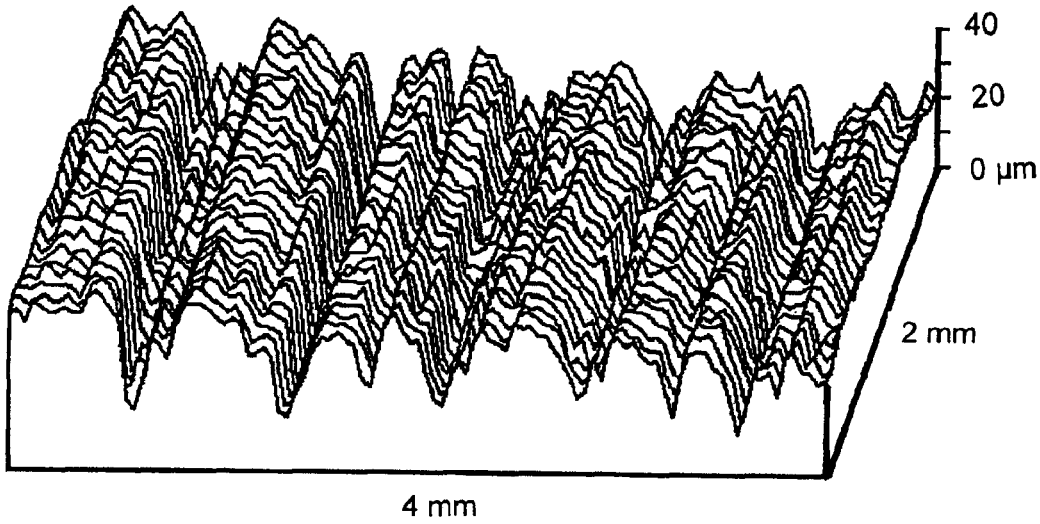
FIG. 3 shows the structure of a positive master for impressing a structure in the nm range used in another embodiment of the method of the present invention.

An Al roll (length 100 mm, diameter 40 mm) with an irregular "pyramid" structure was used. FIG. 3 shows a profilometric record of the pyramidal μm relief structure (structure of the positive master). A lateral macroscopic relief structure can be seen, with structure heights of between 20 and 35 μm. The surface roughness is approximately 4 μm.

Figure 4:
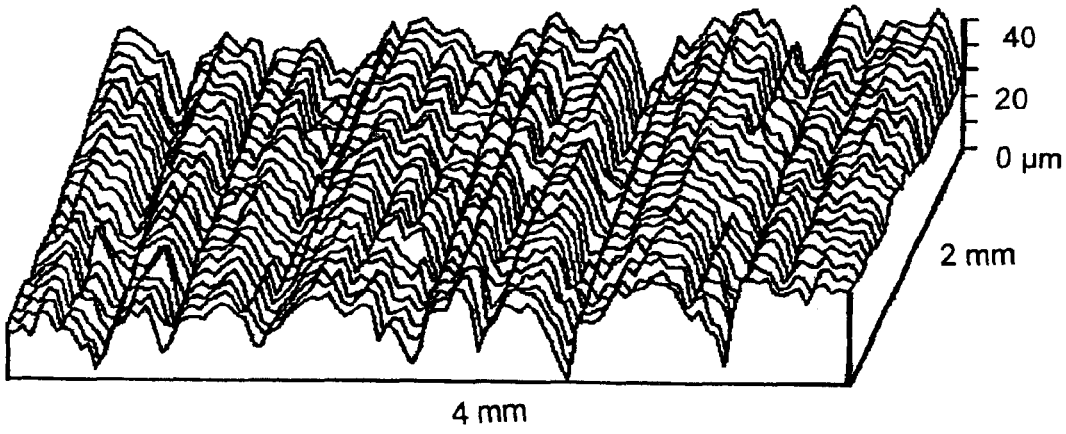
FIG. 4 shows the structure impressed with the master of FIG. 3.

FIG. 4 depicts the corresponding structure reproduced using the negative master. Here again, a lateral macroscopic, pyramidal structure can be seen with structure heights of about 20–30 μm. The slightly lower height of the reproduced structure is attributable to different positions in the master and in the replica, respectively. The surface roughness here as well is about 4 μm, thus demonstrating very faithful reproduction for the μm range as well.

EXAMPLE 2

Preparation of a Coating Composition a) Preparation of the Hydrolyzate

In a 500 ml flask, 20.24 g of zirconium(IV) n-propoxide were mixed with 4.3 g of methacrylic acid and the mixture was stirred for 30 minutes (solution A). In parallel, in another flask, 3.5 g of water and 0.62 g of 0.1 N HCl were added dropwise to 37.2 g of methacryloyloxytrimethoxysilane and this mixture as well was stirred for 30 minutes (solution B). Solution B was then cooled to about 5° C. in an ice bath and solution A was added dropwise. After a further stirring period of about 60 minutes and warming to room temperature, 1.1 g of triethoxytridecafluorooctylsilane were added to the coating sol.

b) Preparation of the End Formulation

Prior to coating, 0.37 g of Irgacure 187 (Union Carbide) was added as photoinitiator to the coating composition.

Production of Microstructured Surface Reliefs

The resultant coating material was applied by flow coating (wet film thickness 25–50 μm) and knife coating (wet film thickness 20 μm) to PMMA sheets measuring 20 cm×20 cm. The coating was then predried in a drying cabinet at 80° C. for 10 minutes. For structuring, the following rolls were used:

a) Hologram Structure

Embossed nickel foil with hologram structure (200–500 nm amplitude height) adhesively bonded to the iron cylinder of a laboratory embossing unit.

b) Digital Structure

Nickel film with readable binary structure (150 nm amplitude height) adhesively bonded to the iron cylinder of a laboratory embossing unit.

c) Embossing Process

The substrates, dried thermally, were structured by means of a laboratory embossing unit. After the embossing operation, the structure was fixed by UV curing using an Hg lamp.

What is claimed is:

1. A method of producing a microstructured surface relief on a substrate, which method comprises:

(a) (i) applying to the substrate a thixotropic coating composition, or (ii) applying to the substrate a coating composition that is not yet thixotropic when applied, followed by making the coating composition thixotropic by treating the coating composition on the substrate;

(b) embossing the surface relief into the thixotropic coating composition with an embossing device substantially without curing the coating composition;

(c) removing the embossing device and, thereafter, (d) curing the embossed coating composition.

2. The method of claim 1, wherein the method comprises (a)(i).

3. The method of claim 2, wherein (a)(i) further comprises enhancing the thixotropic properties of the applied thixotropic coating composition by treatment on the substrate.

4. The method of claim 3, wherein the thixotropic properties are enhanced by by at least one of a thermal treatment and an irradiation treatment.

5. The method of claim 1, wherein the method comprises (a)(ii).

6. The method of claim 5, wherein the coating composition is subjected to at least one of a thermal treatment and an irradiation treatment to render it thixotropic.

7. The method of claim 1, wherein, prior to (b), the thixotropic coating composition has a viscosity of from 30 Pa.s to 30,000 Pa.s.

8. The method of claim 1, wherein, prior to (b), the thixotropic coating composition has a viscosity of from 30 Pa.s to 1,000 Pa.s.

9. The method of claim 1, wherein, prior to (b), the thixotropic coating composition has a viscosity of from 30 Pa.s to 100 Pa.s.

10. The method of claim 1, wherein the embossing device comprises a roll.

11. The method of claim 10, wherein the roll is operated at a speed of from 0.6 m/mm to 60 m/mm.

12. The method of claim 10, wherein the embossing device is applied at a pressure of from 0.1 MPa to 100 MPa.

13. The method of claim 1, wherein (d) comprises curing the embossed coating composition by at least one of a thermal treatment and an irradiation treatment.

14. The method of claim 13, wherein the embossed coating composition is subjected to a thermal treatment.

15. The method of claim 13, wherein the embossed coating composition is subjected to an irradiation treatment.

16. The method of claim 15, wherein the irradiation treatment comprises irradiation by at least one of UV radiation and electron beam radiation.

17. The method of claim 1, wherein (d) takes place within 1 minute following the removal of the embossing device.

18. The method of claim 8, wherein (d) takes place within 30 seconds following the removal of the embossing device.

19. The method of claim 9, wherein (d) takes place within 3 seconds following the removal of the embossing device.

20. The method of claim 1, wherein the cured coating composition is transparent.

21. The method of claim 1, wherein the microstructured surface relief has dimensions of less than 800 $\mu$m.

22. The method of claim 1, wherein the microstructured surface relief has dimensions of less than 500 $\mu$m.

23. The method of claim 1, wherein the microstructured surface relief has dimensions of less than 200 $\mu$m.

24. The method of claim 1, wherein the microstructured surface relief has dimensions of less than 30 $\mu$m.

25. The method of claim wherein the microstructured surface relief has dimensions of less than 1 $\mu$m.

26. The method of claim 1, wherein the coating composition comprises an organic polymer and nanoscale inorganic particulate solids.

27. The method of claim 26, wherein the organic polymer comprises organic radicals comprising crosslinkable functional groups.

28. The method of claim 26, wherein the organic polymer comprises fluorine-substituted organic radicals.

29. A substrate having a microstructured surface relief, obtained by using the method of claim 28.

30. A method of producing a microstructured surface relief on a substrate, which method comprises:

(a) (i) applying to the substrate a thixotropic coating composition, or (ii) applying to the substrate a coating composition that is not yet thixotropic when applied, followed by making the coating composition thixotropic by treating the coating composition on the substrate;

(b) embossing the surface relief into the thixotropic coating composition with an embossing device substantially without curing the coating composition;

(c) removing the embossing device and, thereafter, (d) curing the embossed coating composition;

wherein the coating composition comprises nanoscale inorganic particulate solids comprising organic surface groups that are at least one of addition-polymerizable and polycondensable, wherein prior to (b), the thixotropic coating composition has a viscosity of from 30 Pa.s to 100 Pa.s, wherein (d) takes place within 3 seconds following the removal of the embossing device, wherein the microstructured surface relief has dimensions of less than 200 $\mu$m and wherein the cured coating composition is transparent.

31. A method of producing a microstructured surface relief on a substrate, which method comprises:

(a) (i) applying to the substrate a thixotropic coating composition, or (ii) applying to the substrate a coating composition that is not yet thixotropic when applied, followed by making the coating composition thixotropic by treating the coating composition on the substrate;

(b) embossing the surface relief into the thixotropic coating composition with an embossing device substantially without curing the coating composition;

(c) removing the embossing device and, thereafter, (d) curing the embossed coating composition, wherein the coating composition comprises at least one of an organically modified inorganic polycondensate and a precursor thereof.

32. The method of claim 31, wherein the coating composition further comprises nanoscale inorganic particulate solids.

33. The method of claim 31, wherein the organically modified inorganic polycondensate or precursor thereof comprises a polyorganosiloxane or a precursor thereof.

34. The method of claim 31, wherein the organically modified inorganic polycondensate or precursor thereof comprises organic radicals comprising crosslinkable functional groups.

35. The method of claim 31, wherein the organically modified inorganic polycondensate or precursor thereof comprises fluorine-substituted organic radicals.

36. A substrate having a microstructured surface relief, obtained by using the method of claim 35.

37. A method of producing a microstructured surface relief on a substrate, which method comprises:

(a) (i) applying to the substrate a thixofropic coating composition, or (ii) applying to the substrate a coating composition that is not yet thixotropic when applied, followed by making the coating composition thixotropic by treating the coating composition on the substrate;

(b) embossing the surface relief into the thixotropic coating composition with an embossing device substantially without curing the coating composition;

(c) removing the embossing device and, thereafter, (d) curing the embossed coating composition, wherein the coating composition comprises nanoscale inorganic particulate solids comprising organic surface groups that are at least one of addition-polymerizable and polycondensable.

38. A substrate having a microstructured surface relief, obtained by using the method of claim 37.

* * * * *